United States Patent [19]

Donaldson et al.

[11] 4,280,812

[45] Jul. 28, 1981

[54] METHOD OF IMPARTING SMOLDER RESISTANCE TO COTTON-CONTAINING TEXTILES

[75] Inventors: Darrell J. Donaldson; Robert J. Harper, Jr., both of Metairie, La.

[73] Assignee: The United States of America as represented by the Secretary of Agriculture, Washington, D.C.

[21] Appl. No.: 132,594

[22] Filed: Mar. 21, 1980

[51] Int. Cl.[3] ..... D06M 1/00

[52] U.S. Cl. ..... 8/116 P; 8/181; 8/182; 8/196

[58] Field of Search ..... 8/116 P, 181, 182, 196

[56] References Cited

U.S. PATENT DOCUMENTS

| | | | |
|---|---|---|---|
| 4,012,507 | 3/1977 | Knoepfler et al. | 428/389 |
| 4,037,019 | 7/1977 | Steger | 428/469 |

FOREIGN PATENT DOCUMENTS 52-18999 2/1977 Japan .

OTHER PUBLICATIONS

Ermolenko, I. N. et al., Chem Abs., 1971, 75, 22759e.
McCarter, R. J., Chem. Abs., 1978, 89, 76594e.

*Primary Examiner*—A. Lionel Clingman
*Attorney, Agent, or Firm*—M. Howard Silverstein; David G. McConnell; Raymond C. Von Bodungen

[57] ABSTRACT

Smolder resistance is imparted to cotton and cotton-containing fabrics by applying a certain boron-nitrogen-phosphorus system to the fabric, employing conventional equipment. An inorganic boron compound is placed in solution with a phosphorus-containing compound, then a nitrogen-containing compound is added. The aqueous mixture is applied using conventional textile equipment, dried, and cured by standard methods.

10 Claims, No Drawings

METHOD OF IMPARTING SMOLDER RESISTANCE TO COTTON-CONTAINING TEXTILES

BACKGROUND OF THE INVENTION (1) Field of the Invention

This invention relates to the application of chemical treatments to cotton and cotton-containing fabrics to impart smolder resistance to the products made therefrom. The method of this invention is of particular significance to the users of upholsterytype, heavy weight fabrics, and is considered a substantial improvement over the known smolder-retardant finishes.

(2) Description of the Prior Art

It is known that cellulosic fabrics are highly susceptible to cigarette ignition, a smoldering-type reaction. It is also known that the mechanism of flame retardance and smolder resistance are decidedly different, so much so that flame retardant fabrics generally contribute to smoldering hazard associated with textiles.

The smoldering characteristics and imparting smolder-resistance to cotton-containing fabrics have been studied very little. Backcoating with a latex or treatment with sulfur, or with boric acid, have been mentioned in the literature as methods for imparting smolder resistance to cotton-containing fabrics.

Nestor Knoepfler et al disclose in U.S. Pat. No. 4,012,507 a vapor-phase boric acid treatment for application to cotton batting. Special equipment and techniques must be employed in that process, thus making it unattractive for its use with heavyweight upholstery textiles.

Chemcial Abstracts (C.A. 89, 76594e), indicates that McCarter in patent application Ser. No. 870,385 now abandoned discloses the use of sulfur as a smolder inhibiting agent for cellulosic insulations. The method of application indicated by that disclosure indicates that it is not practical for fabrics. Sulfur requires relatively large amounts of deposition on the substrate to be capable of imparting smolder resistance. Results obtained in the deposition on heavyweight fabrics have been erratic. The resulting fabrics are quickly associated with the obnoxious odor of sulfur.

Backcoating as a method of imparting smolder resistance is objectionable because the coatings impair the aesthetic properties of certain fabrics, essentially heavyweight fabrics, and therefore backcoatings do not lend themselves to applications to all types of cotton-containing fabrics.

Dusting and hot aqueous treatments have been mentioned as smolder-resistant process for cellulosic materials. The dusting of boric acid as applied to batting is not feasible for textiles. The hot aqueous treatment requires energy to be supplied to the solution at all times, thus making the system unattractive. Also, such a system is not ameanable for use on low wet pickup finishing equipment. Also, the availability of boric acid is limited thereby making the treatment economically impractical.

SUMMARY OF THE INVENTION

A process for imparting smolder resistance to cotton and cotton-containing fabrics is disclosed. Tests indicate that there is a synergistic effect in the combination of boron, phosphorus, and nitrogen, and in imparting resistance to cigarette ignition to these textiles when applied under the proper conditions. An aqueous solution containing a boron compound is mixed with a phosphorus-containing compound, then an N-methylol compound is added. This solution is then applied to a cotton or cotton-containing textile, dried, then cured.

The main object of this invention is to provide a means of rendering these textiles smolder resistant. This has been accomplished by the process of the present invention, which was designed to be employed particularly in the treatment of upholstery-type fabric, employing conventional textile equipment, especially those suitable to the use of low energy.

DESCRIPTION OF THE PREFERRED EMBODIMENTS

In the process of the present invention, generally, the preferred embodiment consists of (a) formulating the chemical mixture which contains the right porportions of a boron compound preferably borax—a phosphorus compound and an N-methylol compound, (b) impregnating the organic fibrous material (the fabric) with the aqueous solution, (c) drying the impregnated fabric, and (d) curing the fabric, thus producing in the fibrous structure insoluble polymeric materials which contain synergistic proportions of boron, phosphorus, and nitrogen.

Specifically, the present invention provides smolder resistant organic fibrous material and a process for producing said material by any convenient technique, such as by padding or loop-transfer onto the fabric, to a wet pickup of about from 15% to 100% with a solution containing borax, for example, in a percentage of about 5% to 35% in combination with a phosphorus compound such as, for example, phosphoric acid in a percentage of about from 1% to 7%, and an N-methylol compound in a percentage of about from 2.5% to 15%. The preferred drying conditions are temperatures of about 120° to about 185° F. for about from 2 to 12 minutes, using the longer times with the lower temperatures. This is follwed by a preferred curing of about from 1 to 7 minutes at about from 125° to 300° F.

The preferred solution for impregnating the organic fibrous material of this invention are prepared thusly; Borax is suspended in water, and the preferred phosphorus agent is added, until the borax is completely dissolved, to give a solution containing about from 5% to 40% borax, the preferred range being 9% to 29%. To this solution the nitrogenous agent is added with stirring, to give a concentration of 1% to 15%, the preferred range being 2.5% to 12%.

Suitable N-methylol compounds are amides prepared by reacting formaldehyde with amides of the group glycoluril, urea, dihydroxyethylene urea, melamines, triazones, triazines, and carbamates. Although these would be preferred because of the availability of experimental data on these one should not expect this fact to limit the scope of the N-methylol compounds of this invention.

Phosphorus compound suitable for the process of the present invention are phosphoric acid, monosodium phosphate, disodium phosphate, trisodium phosphate, monoammonium phosphate, diammonium phosphate, and triammonium phosphate, in the range of 1.0% to 10%, the preferred concentration being about from 2.5% to 6%.

We have found that by reacting a boron compound, for example borax, with a phosphorus compound, such as phosphoric acid, and an N-methylol nitrogen compound, such as methylated trimethylolmelamine (MTMM) a product is obtained that imparts a high degree of smolder retardance to cotton-containing textiles. The need for all three agents together with their synergistic activity can be clearly seen in the results of a number of experiments, as shown in Table I. These applications were made on 100% cotton fabric.

In these evaluations $B_2O_3$ concentration was determined by an alkali titration of aliquots obtained by aqueous extracts of the cotton samples. Smolder resistance was measured by the proposed cigarette ignition test of the National Bureau of Standards. In Table I the lowest class is D, and the highest class, using fiberglass panel substrate is class B. The applications were made onto 16 oz/yd$^2$ cotton fabric.

TABLE I

| Treatment | Add-on % | $B_2O_3$ % | Class |
|---|---|---|---|
| Borax (alone) | 10.6 | 5.75 | D |
| MTMM (alone) | 15.0 | none | C |
| Borax-$H_3PO_4$ | 7.8 | 4.07 | C |
| Borax-$H_3PO_4$—MTMM | 8.0 | 2.73 | B |
| Note: When the applications were made onto 9.8 oz/yd$^2$ the following observations were made. | | | |
| Borax-TMM | 5.6 | 1.89 | D |
| Borax $H_3PO_4$—MTMM | 4.7 | 1.86 | B |

The importance of the inclusion of the phosphorus compound in the process of the present invention is demonstrated in the following table (Table II). Applications are to 16 oz/yd$^2$ 100% cotton fabric.

TABLE II

| Compound | Concentration % | Add-on % | $B_2O_3$ % | Class |
|---|---|---|---|---|
| $H_3PO_4$ | 2.5 | 9.2 | 2.78 | B |
| $(NH_4)H_2PO_4$ | 3.3 | 13.0 | 2.97 | B |
| $(NH_4)_2HPO_4$ | 4.1 | 9.9 | 2.89 | B |
| $NaH_2PO_4$ | 4.1 | 11.1 | 3.43 | B |
| Oxalic Acid | 3.0 | 10.3 | 2.86 | D |
| Glycolic Acid | 3.0 | 9.1 | 2.89 | D |
| Citric Acid | 2.5 | 11.6 | 3.54 | D |

The acids such as oxalic, and the like, dissolved the borax but did not impart any smolder resistance to cotton textiles. Therefore, one must conclude that the phosphorus compound does not just function as a dissolving agent for borax or for the possible formation of boric acid but is an integral and necessary part of the system for imparting smolder resistance. This invention for imparting smolder resistance shows the synergistic effect of three types of compounds, namely boron-, phosphorus-, and nitrogen-containing compounds.

Impregnated organic fibrous materials are dried and heated to an elevated temperature by any conventional manner, such as, for example, an oven, to produce the insoluble material in and on the fibers. It is of advantage to dry the organic fibrous material at a temperature of about from 120° to 185° F. before it is cured at a temperature of about from 225° to 275° F. However, it can also be dried and cured in a single step at the temperature range of about from 225° to 300° F.

Application of the treatment can be done with any textile equipment, such as, for example, with a padder, spray, vacuum impregnator, or foam and transfer technique equipment.

The transfer technique being perferred because less wet pickup is attained and therefore affords a considerable saving of costly energy. This system is particularly suitable to such application. The attractiveness of such a system is enhanced because of surface (pile fabrics) of the organic fibrous materials. Low wet pickup systems are also equally suitable for heavy weight materials where large amounts of energy are necessary for drying these materials.

Surface active agents, water repellants, soil-release agents and other conventional textile modifiers can be added to the treating emulsion.

In the process of the invention the terms "organic fibrous material" or "textile material" include cellulosic fibers, such as cotton, ramie, rayon, paper, cardboard, and their physical and chemical modifications, and thermoplastic fibers, such as polyester, polypropylene, polyamide, acrylics, and acetate.

The following examples are provided to illustrate the invention and should not be construed as limiting the invention in any manner whatever.

EXAMPLE 1

A 16 oz/yd$^2$ 100% cotton fabric was padded to give a 73% wet pickup with a solution containing 10% borax, 2.5% $H_3PO_4$, and 5% trimethylolmelamine. The fabric was dried at 185° F. for 10 minutes and cured at 250° F. for 4 minutes. The fabric after equilibration had 9.2% add-on containing 2.78% $B_2O$. The fabric was determined to be Class B. [for the classifying of these refer to Proposed Standard for the Flammability (Cigarette Ignition Resistance) of Upholstered Furniture (PFF 6-78)].

EXAMPLE 2

A 9.8 oz/yd$^2$ 100% cotton fabric was padded to give a 54% wet pickup with a solution containing 10% borax, 2.5% $H_3PO_4$, and 5.2% dimethyloldihydroxyethylene urea. The sample was dried at 185° F. for 12 minutes, and cured at 275° F. for 7 minutes. The fabric had a 6.2% add-on containing 2.28% $B_2O_3$. The fabric was determined to be in Class B.

EXAMPLE 3

A 20 oz/yd$^2$ 41% rayon—59% cotton fabric was padded with a solution containing 7% borax, 2% $H_3PO_4$, and 3.5% methylated trimethylolmelamine (MTMM) to give a 100% wet pickup. The fabric was dried at 185° F. for 12 minutes, and cured at 275° F. for 7 minutes. The fabric had 7.0% add-on containing 2.53% $B_2O_3$, and was determined to be in Class B.

EXAMPLE 4

The procedure of Example 1 was followed except that 3.3% monoamonium phosphate was substituted for $H_3PO_4$. The fabric had a 13% add-on containing 5.65% $B_2O_3$, and was determined to be in Class B.

EXAMPLE 5

The procedure of Example 1 was followed except that 4.1% diammonium phosphate was substituted for $H_3PO_4$. The fabric had a 9.9% add-on containing 2.89% $B_2O_3$, and was determined to be Class B.

EXAMPLE 6

The procedure of Example 1 was followed except that 4.1% disodium phosphate was submitted for $H_3PO_4$. The fabric had 11.1% add-on containing 3.43% $B_2O_3$, and was determined to be Class B.

EXAMPLE 7

A 9.8 oz/yd$^2$ cotton fabric was loop-transfered with a solution containing 29% borax, 6% $H_3PO_4$, 5% methylated trimethylolmelamine (MTMM), and 4% styrene-butadiene-vinylidene chloride (a latex additive) to give a wet pick up of 19%. The treatment was transferred to the back of the fabric. The fabric was dried 185° F. for 7 minutes, and dried 275° for 7 minutes. The fabric had a 5.9% add-on containing 2.19% $B_2O_3$, and was determined to be Class B.

EXAMPLE 8

An 11.3 oz/yd$^2$ 100% cotton fabric and a 20.2% 49% rayon—23% cotton—25% acetate—3% polyester fabric were padded with a solution containing 5% borax, 1.3% $H_3PO_4$, and 5% MTMM. The cotton fabric and the blend fabric had 87% and 97% wet pickup, respectively. The samples were dried 12 minutes at 185° F., and cured at 275° F. for 7 minutes. The 100% cotton fabric had an add-on of 6.8% containing 1.84% $B_2O_3$, and the blend fabric had a 7.3% add-on containing 2.39%. Both samples were determined to be Class B.

EXAMPLE 9

A 16 oz/yd 100% cotton fabric was loop-transfered so that a solution containing 29% borax, 5.5% $H_3PO_4$, and 12% MTMM was applied to the face of the fabric to give a 37% wet pickup. The fabric, after drying for 7 minutes at 185° F., and curing for 7 minutes at 275° F. had an add-on of 13.4% containing 3.88% $B_2O_3$, and was determined to be Class B.

EXAMPLE 10

A 20.2 oz/yd 49% rayon—23% cotton—25% acetate—3% polyester fabric was treated with a soluition containing 22% borax, 5.5% $H_3PO_4$, and 10.5% MTMM to give an 18% wet pickup. The fabric was dried at 185° F. for 5 minutes and cured at 275° F. for 5 minutes. The fabric had a 4.3% add-on and was determined to be Class B.

We claim:

1. A process for imparting smolder resistance to cotton and cotton-containing fabric, the process comprising:

(a) preparing an aqueous solution of a mixture consisting of
  (1) a boron compound,
  (2) a compound containing an N-methylol group, and
  (3) a phosphorus compound, (b) applying the solution of (a) onto a cotton fabric or onto a cotton-containing fabric, to a wet-pickup of about from 15% to 100%, (c) drying the impregnated fabric at a temperature of about from 120° to 185° F. for about from 10 to 2 minutes, respectively, and (d) curing the dried fabric at a temperature of about from 225° to 300° F. for about from 7 to 1 minutes, respectively.

2. The process of claim 1 wherein the total solids concentration of the solution is about from 10% to 47% by weight.

3. The process of claim 1 wherein the boron compound is borax.

4. The process of claim 1 wherein the boron content of the solution is about from 5% to 35%.

5. The process of claim 1 wherein the compound containing an N-methylol group is selected from the group consisting of:
trimethylolmelamine,
methylated trimethylolmelamine, and
dimethylol dihydroxyethylene urea.

6. The process of claim 1 wherein the N-methylol compound content of the solution is about from 2.5% to 15%.

7. The process of claim 1 wherein the phosphorus compound is selected from the gorup consisting of:
phosphoric acid,
sodium phosphate, and
ammonium phosphate.

8. The process of claim 1 wherein the phosphorus compound content of the solution is about from 1% to 7%.

9. In a process for imparting smolder resistance to cotton and cotton-containing fabric wherein a chemical formulation containing phsophorus compounds and other known flame and smolder retardants are applied to the fabric, the improvement comprising;

(a) preparing a 30–50% aqueous solution containing a mixture of boron compound, a compound containing an N-methylol group, and a phosphorus compound, in a weight to weight percentage proportions respectively of about 5.8%:1%:1.1%, (b) applying the solution of (a) by means of a loop-transfer system to obtain a low concentration of water, and (c) drying and curing the formulation on the fabric.

10. A process comprising:

(a) treating cotton containing fabric with an aqueous solution containing a suitable boron compoound, a suitable compound containing an N-Methylol group, and a suitable phosphorus compound in amounts sufficient to impart smolder resistance to said cotton containing fabric;

(b) drying the treated fabric; and (c) curing the dryed fabric.

* * * * *